US011363869B2

(12) United States Patent
Richardson

(10) Patent No.: US 11,363,869 B2
(45) Date of Patent: Jun. 21, 2022

(54) HAIR COLORING BRUSH AND SYSTEM

(71) Applicant: Jackie Richardson, St. Louis, MO (US)

(72) Inventor: Jackie Richardson, St. Louis, MO (US)

( * ) Notice: Subject to any disclaimer, the term of this patent is extended or adjusted under 35 U.S.C. 154(b) by 0 days.

(21) Appl. No.: 16/537,401

(22) Filed: Aug. 9, 2019

(65) Prior Publication Data

US 2020/0015564 A1 Jan. 16, 2020

Related U.S. Application Data

(63) Continuation-in-part of application No. 15/226,813, filed on Aug. 2, 2016, now Pat. No. 10,420,408.

(51) Int. Cl.

| | |
|---|---|
| ***A45D 19/06*** | (2006.01) |
| ***A46B 5/02*** | (2006.01) |
| ***A46B 9/02*** | (2006.01) |
| ***A45D 19/00*** | (2006.01) |
| ***A46B 15/00*** | (2006.01) |

(52) U.S. Cl.

CPC ..... *A45D 19/012* (2021.01); *A45D 19/06* (2013.01); *A46B 5/021* (2013.01); *A46B 9/026* (2013.01); *A46B 9/028* (2013.01); *A46B 15/0055* (2013.01); *A45D 19/0066* (2021.01); *A46B 2200/1046* (2013.01)

(58) Field of Classification Search

CPC ... A46B 5/021; A46B 9/023; A46B 2200/104; A46B 2200/1046; A46B 9/026; A45D 19/02; A45D 19/0008; A45D 19/00; A45D 19/062; A45D 19/0066; A45D 2019/0083; A45D 2019/0091; A45D 19/012

USPC ..... D4/135; D28/20

See application file for complete search history.

(56) References Cited

U.S. PATENT DOCUMENTS

| | | | | |
|---|---|---|---|---|
| 2,017,567 | A * | 10/1935 | Meyer | A45D 19/02 401/123 |
| 3,349,781 | A | 10/1967 | Poole et al. | |
| 5,289,835 | A | 3/1994 | Harlan et al. | |
| 8,118,037 | B2 | 2/2012 | Cardenas et al. | |

(Continued)

OTHER PUBLICATIONS

Mudder 5 Pack Hair Dye Coloring Brushes by Mudder; https://www.amazon.ca/Mudder-Coloring-Brushes-Dyeing-Tinting/dp/B0732QNSS3/ref=sr_1_fkmr3_1?dchild=1&keywords=mudder+5-pack+hair+dye&qid=1600974922&sr=8-1-fkmr3; accessed on Sep. 24, 2020; published on Feb. 28, 2018. (Year: 2018).*

(Continued)

*Primary Examiner* — Daniel J Colilla

(74) *Attorney, Agent, or Firm* — David H. Chervitz

(57) ABSTRACT

A hair coloring brush has a central base portion having a curved end portion, a front side, and an indentation formed in the front side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, a pick handle extending from the central base portion, and a plurality of bristles extending out from the curved end portion of the central base portion, the bristles each have an end portion with the end portions forming a curved surface.

20 Claims, 12 Drawing Sheets

(56) References Cited

U.S. PATENT DOCUMENTS

| | | | | |
|---|---|---|---|---|
| 2007/0144550 | A1 | 6/2007 | Roher | |
| 2007/0169789 | A1* | 7/2007 | Castagno | A45D 19/02 132/320 |
| 2011/0114107 | A1 | 5/2011 | Muhl et al. | |
| 2019/0166985 | A1* | 6/2019 | Taine | A46D 1/0253 |

OTHER PUBLICATIONS

Diane 7-Piece Hair Coloring Kit by Diane; https://www.amazon.ca/Diane-7-Piece-Hair-Coloring-Kit/dp/B0012XVFT4/ref=sr_1_1?dchild=1&keywords=diane+7-piece+hair+coloring+kit&qid=1600975037&sr=8-1, accessed on Sep. 24, 2020; published on Oct. 29, 2014. (Year: 2014).*

MissLytton Hair Color Tool Kit by MissLytton; https://www.amazon.com/MissLytton-Professional-Highlighting-Coloring-Applicator/dp/B0769D6XLY/ref=sr_1_2?dchild=1&keywords=misslytton+hair+color+tool+kit&qid=1600975202&sr=8-2, accessed on Sep. 24, 2020; published on Oct. 9, 2017. (Year: 2017).*

Annie Silicone Dye Brush Set of 6 Pieces; https://www.amazon.ca/Annie-Silicone-Pieces-Relaxers-Highlights/dp/B01561GJP2/ref=sr_1_1?dchild=1&keywords=annie+silicone+dye+brush+set&qid=1600975278&sr=8-1; accessed on Sep. 24, 2020; published on May 24, 2017. (Year: 2017).*

* cited by examiner

HAIR COLORING BRUSH AND SYSTEM

RELATED APPLICATION

This application is a continuation-in-part of U.S. patent application Ser. No. 15/226,813 that was filed on Aug. 2, 2016, the disclosure of which is incorporated herein by reference.

BACKGROUND OF THE DISCLOSURE

This disclosure relates to a hair brush and more particularly to a hair coloring brush and a hair coloring brush system.

Hair coloring is a complex technique in which a color dye is applied to hair to change, cover, or enhance the natural color of hair. A color dye is made by mixing various colors and chemicals in a receptacle to obtain a desired color to be applied to hair. Once the desired color is obtained the color is slowly and laboriously applied to sections of hair by a brush. As can be appreciated, this is a time consuming process which may take up to forty-five minutes or more before the color is properly applied in a desired amount. Compounding this problem is the fact that the brushes being used to apply the color are small and only cover a portion of a section of hair to be dyed. Multiple strokes or passes are required to dye a section of hair. This adds to the time and energy required to dye hair. Also, if a colorist is being used then the amount charged by the colorist is increased due to the increased time required to apply dye to hair. It is also know that the receptacle or bowl in which dye and other chemicals are mixed is not large and only a small batch of dye may be mixed at a time. In view of this, if the amount of dye is underestimated then another batch may have to be mixed. Again, this adds to the time and expense of dyeing hair.

The present hair coloring brush is designed to obviate and overcome many of the disadvantages and shortcomings associated with prior hair coloring brushes. Further, the present hair coloring brush provides increased surface area for applying dye to a larger area or section of hair to reduce the time it takes to color hair. Moreover, the present hair coloring brush system provides a hair brush having a brush surface area for applying a color dye and a receptacle for holding a color dye.

SUMMARY OF THE DISCLOSURE

In one form of the present disclosure, a hair coloring brush is disclosed which comprises a central base portion having a curved end portion, a front side, and an indentation formed in the front side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, a pick handle extending from the central base portion, and a plurality of bristles extending out from the curved end portion of the central base portion, the bristles each have an end portion with the end portions forming a curved surface.

In another form of the present disclosure, a hair coloring brush comprises a central base portion having a curved end portion, a front side, a back side, an indentation formed in the front side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, and an indentation formed in the back side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, a pick handle extending from the central base portion, and a plurality of bristles extending out from the central base portion, the bristles each have an end portion with the end portions forming a curved surface.

In yet another form of the present disclosure, a hair coloring brush system is disclosed which comprises a central base portion having a curved end portion, a front side, and an indentation formed in the front side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, a pick handle extending from the central base portion, a plurality of bristles extending out from the central base portion, the bristles each have an end portion with the end portions forming a curved surface, and a bowl for holding a quantity of dye and having a basin for receiving the bristles and the central base portion.

In light of the foregoing comments, it will be recognized that the present disclosure provides a hair coloring brush that is of simple construction and design and which can be easily employed with highly reliable results.

The present disclosure also provides a hair coloring brush that employs lightweight structures or components to allow an operator to use the brush for extended periods of time without fatigue.

The present disclosure further provides a hair coloring brush that allows for dye to be applied to hair quickly.

The present disclosure is also directed to a hair coloring brush that allows dye to be applied to a large section of hair to reduce the time required for applying dye.

The present disclosure provides a hair coloring brush that conforms to the shape of a head for applying dye quickly to hair.

The present disclosure is directed to a hair coloring brush that is easy to grasp and manipulate during use.

The present disclosure is further directed to a hair coloring brush system that provides for a large section of hair to be colored in a short amount of time.

These and other objects and advantages of the present disclosure will become apparent after considering the following detailed specification in conjunction with the accompanying drawings, wherein

DETAILED DESCRIPTION OF AN EMBODIMENT

Figure 1:
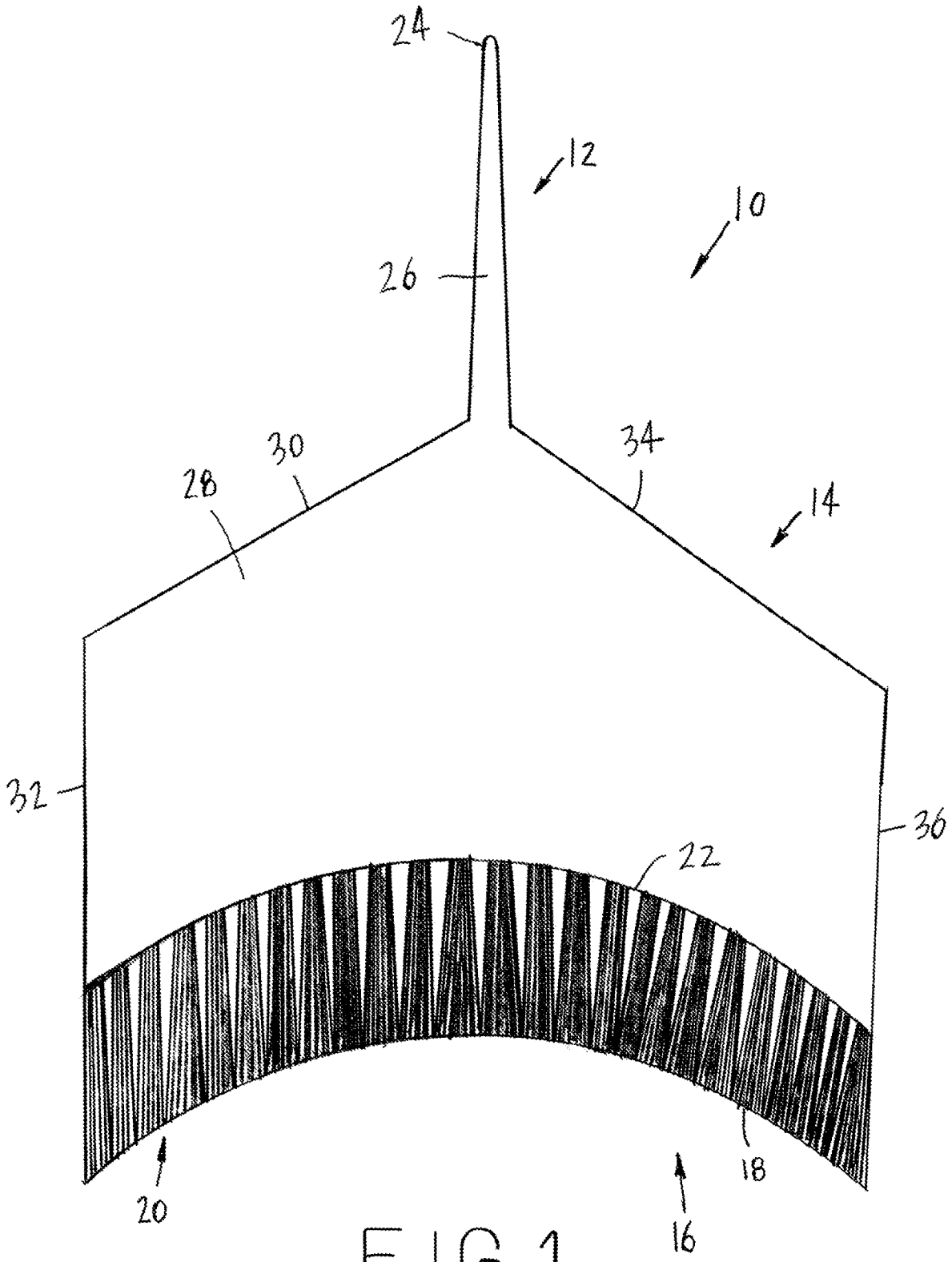
FIG. 1 is a front perspective view of a hair coloring brush constructed according to the present disclosure.

Referring now to the drawings, wherein like numbers refer to like items, number 10 identifies an embodiment of a hair coloring brush constructed according to the present disclosure. With reference now to FIG. 1, the hair coloring brush 10 is shown comprising a pick handle 12, a central base portion 14, and a plurality of bristles 16 extending out from the central base portion 14. The bristles 16 each have an end portion 18 with the end portions 18 forming a curved surface 20. The central base portion 14 has a curved end portion 22 from which the bristles 16 extend. The pick handle 12 has an end 24 and a tapered portion 26 that extends from the central base portion 14 to the end 24. The pick handle 12 is used to assist in sectioning hair that needs to be colored or dyed by the brush 10. The central base portion 14 has a front side 28 that is large and is adapted for a hand of an operator of the brush 10 to be able to firmly grasp. The central base portion 14 also has a first angled side portion 30, a first straight side portion 32, a second angled side portion 34, and a second straight side portion 36. The first angled side portion 30 is between the tapered portion 26 and the first straight side portion 32. The first straight side portion 32 ends at the curved end portion 22. The second angled side portion 34 is between the tapered portion 26 and the second straight side portion 36. The second straight side portion 36 also terminates at the curved end portion 22. As can be appreciated, the curved surface 20 of the end portions 18 of the bristles 16 are used to follow the contoured shape of a head. In this manner, it will be easy to stroke hair with dye (not shown) applied to the brush 10 or apply dye to hair by using the brush 10. The curved end portion 22 provides a guide for applying dye to hair associated with the contoured shape of the head. By way of example only, the distance between the first straight side portion 32 and the second straight side portion 36 may be between 2¾ inches and 7 inches. The brush 10 has the central base portion 14 wider or larger than any prior brush which results in a wider or larger surface 20 than any prior brush will allows more dye to be applied to hair in one stroke of the brush 10. Further, although the side portions 30, 32, 34, and 36 are disclosed, it is to be understood that the central base portion 14 may be produced having any side portions such as a square shape, a rectangular shape, or a semicircular shape.

Figure 2:
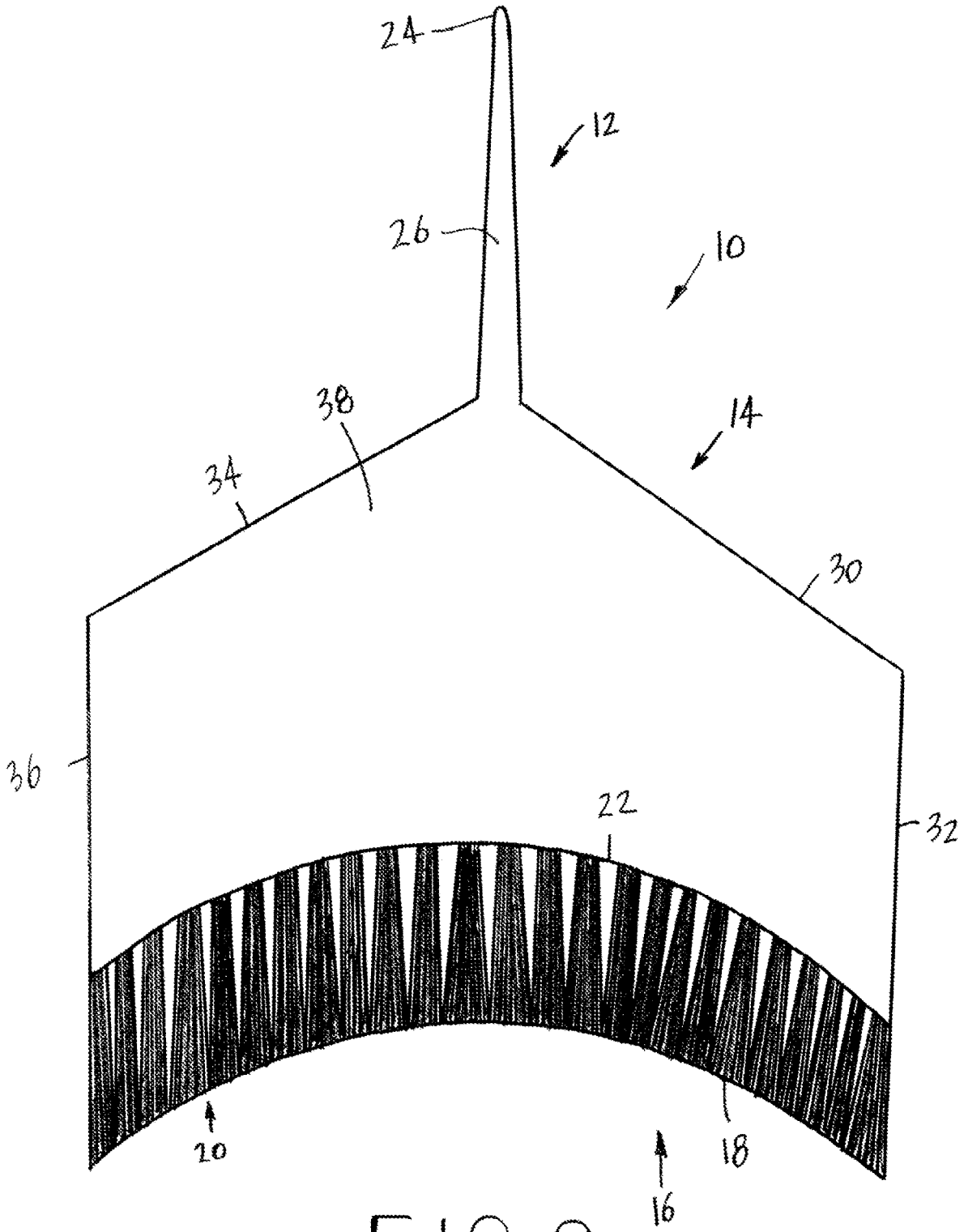
FIG. 2 is a back perspective view of the hair coloring brush shown in FIG. 1 constructed according to the present disclosure.

FIG. 2 illustrates a back perspective view of the hair coloring brush 10. The hair coloring brush 10 is shown comprising the pick handle 12, the central base portion 14, and the plurality of bristles 16 extending out from the central base portion 14. The bristles 16 each have the end portion 18 with the end portions 18 forming the curved surface 20. The central base portion 14 also has the curved end portion 22 from which the bristles 16 extend. The pick handle 12 has the end 24 and the tapered portion 26 that extends from the central base portion 14 to the end 24. The central base portion 14 has a back side 38 that is large and is adapted for a hand of an operator of the brush 10 to be able to firmly grasp. The central base portion 14 is also shown having the first angled side portion 30, the first straight side portion 32, the second angled side portion 34, and the second straight side portion 36.

Figure 3:
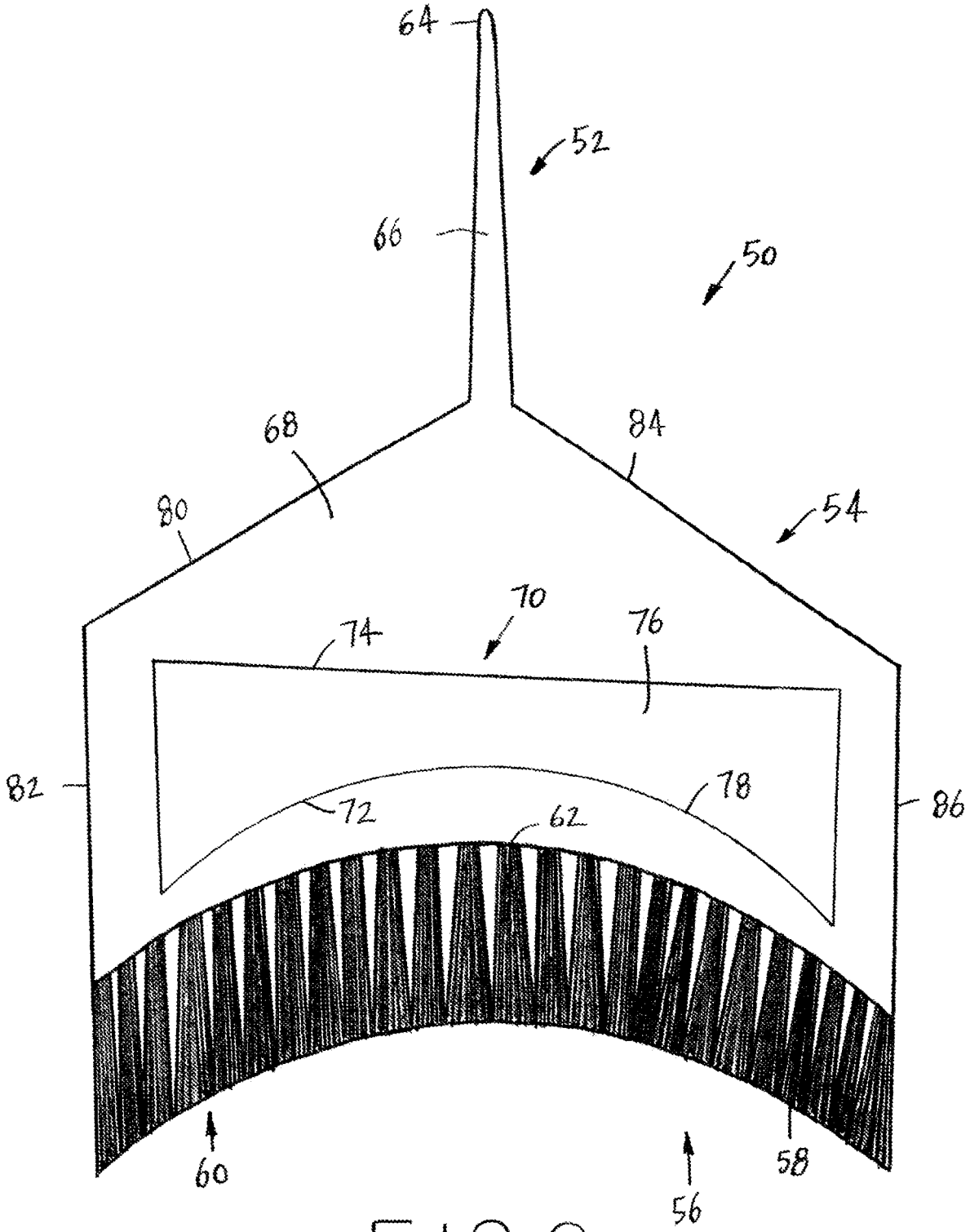
FIG. 3 is a front perspective view of another embodiment of a hair coloring brush constructed according to the present disclosure.

With reference now to FIG. 3, another embodiment of a hair coloring brush 50 is shown. The hair coloring brush 50 comprises a pick handle 52, a central base portion 54, and a plurality of bristles 56 extending out from the central base portion 54. The bristles 56 each have an end portion 58 with the end portions 58 forming a curved surface 60. The central base portion 54 has a curved end portion 62 from which the bristles 56 extend. The pick handle 52 has an end 64 and a tapered portion 66 that extends from the central base portion 54 to the end 64. The pick handle 52 is used to assist in sectioning hair that needs to be colored or dyed by the brush 50. The central base portion 54 has a front side 68 that is large and is adapted for a hand of an operator of the brush 50 to be able to firmly grasp. The central base portion 54 has an indentation 70 formed in the front side 68. The indentation 70 has a curved bottom end 72 and a straight upper end 74. The indentation 70 provides an area 76 for grasping the brush 50 in a comfortable manner by an operator or user of the brush 50. The curved bottom end 72 provides a surface 78 against which fingers of an operator may be positioned for more control of the brush 50. The central base portion 54 also has a first angled side portion 80, a first straight side portion 82, a second angled side portion 84, and a second straight side portion 86. The first angled side portion 80 is between the tapered portion 66 and the first straight side portion 82. The first straight side portion 82 ends at the curved end portion 62. The second angled side portion 84 is between the tapered portion 66 and the second straight side portion 86. The second straight side portion 86 also terminates at the curved end portion 62. As can be appreciated, the curved surface 60 of the end portions 58 of the bristles 56 are used to follow the contoured shape of a head. In this manner, it will be easy to stroke hair with dye (not shown) applied to the brush 50 or apply dye to hair by using the brush 50. The curved end portion 62 provides a guide for applying dye to hair associated with the contoured shape of the head.

Figure 4:
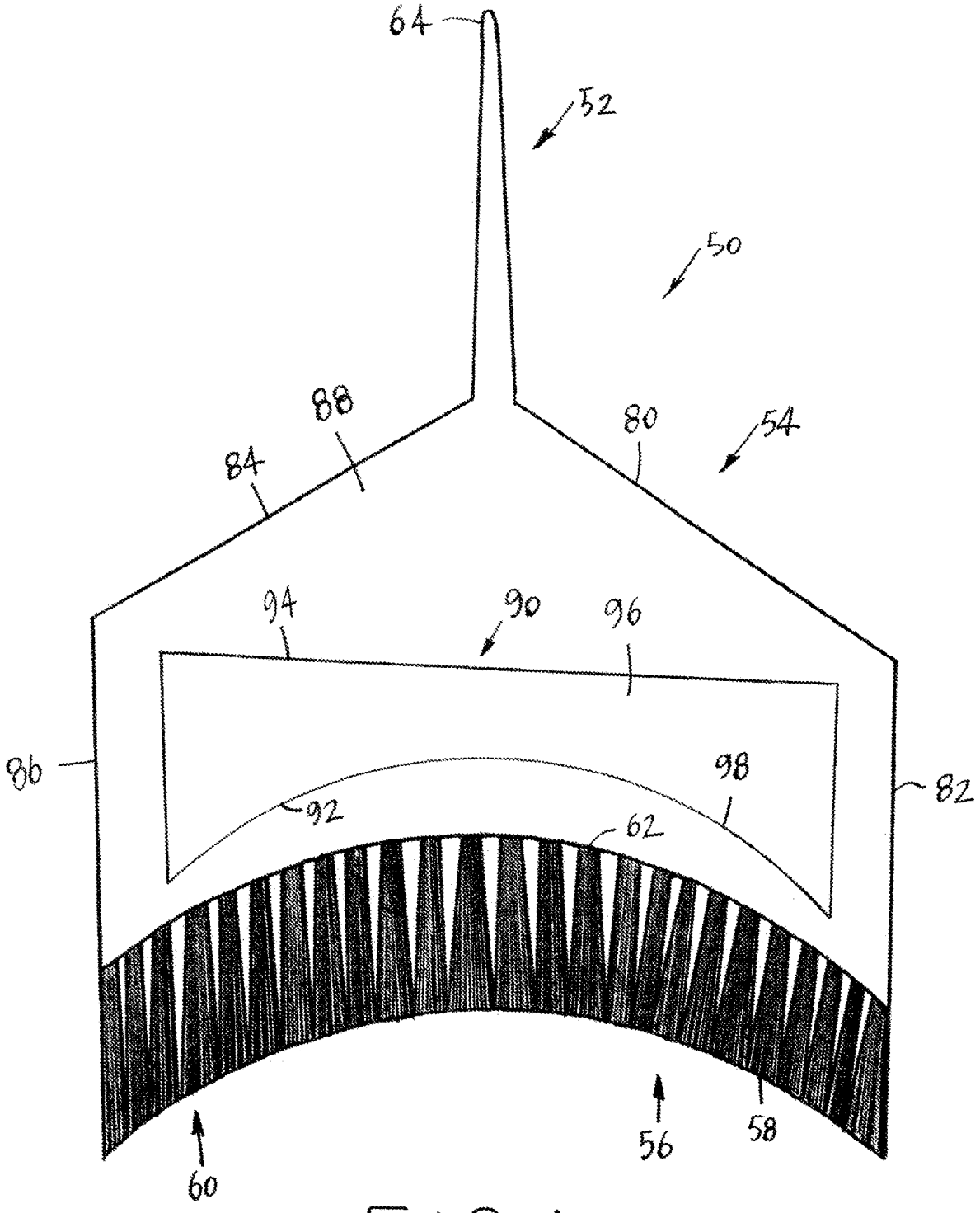
FIG. 4 is a back perspective view of the hair coloring brush shown in FIG. 3 constructed according to the present disclosure.

FIG. 4 depicts a back perspective view of the brush 50. The hair coloring brush 50 is shown comprising the pick handle 52, the central base portion 54, and the plurality of bristles 56 extending out from the central base portion 54. The bristles 56 each have the end portion 58 with the end portions 58 forming the curved surface 60. The central base portion 54 also has the curved end portion 62 from which the bristles 56 extend. The pick handle 52 has the end 64 and the tapered portion 66 that extends from the central base portion 54 to the end 54. The central base portion 54 has a back side 88 that is large and is adapted for a hand of an operator of the brush 50 to be able to firmly grasp. The central base portion 54 is also shown having the first angled side portion 80, the first straight side portion 82, the second angled side portion 84, and the second straight side portion 86. The central base portion 54 has an indentation 90 formed in the back side 88. The indentation 90 has a curved bottom end 92 and a straight upper end 94. The indentation 90 provides an area 96 for grasping the brush 50 in a comfortable manner by an operator or user of the brush 50. The curved bottom end 92 provides a surface 98 against which fingers of an operator may be positioned for more control of the brush 50. Although the indentation 90 is shown, it is possible that the central base portion 54 on the back side 88 may not have the indentation 90 formed therein. By having one indentation 70 or 90 formed in the brush 50, a user of the brush 50 will be able to know which direction dye is being applied by the brush 50. For example, if the brush 50 is to be moved only in a downward direction then knowing that the indentation 70 is only on the front side 68 of the brush 50 will allow the user to be able to orientate the brush 50 for a downward stroke.

Figure 5:
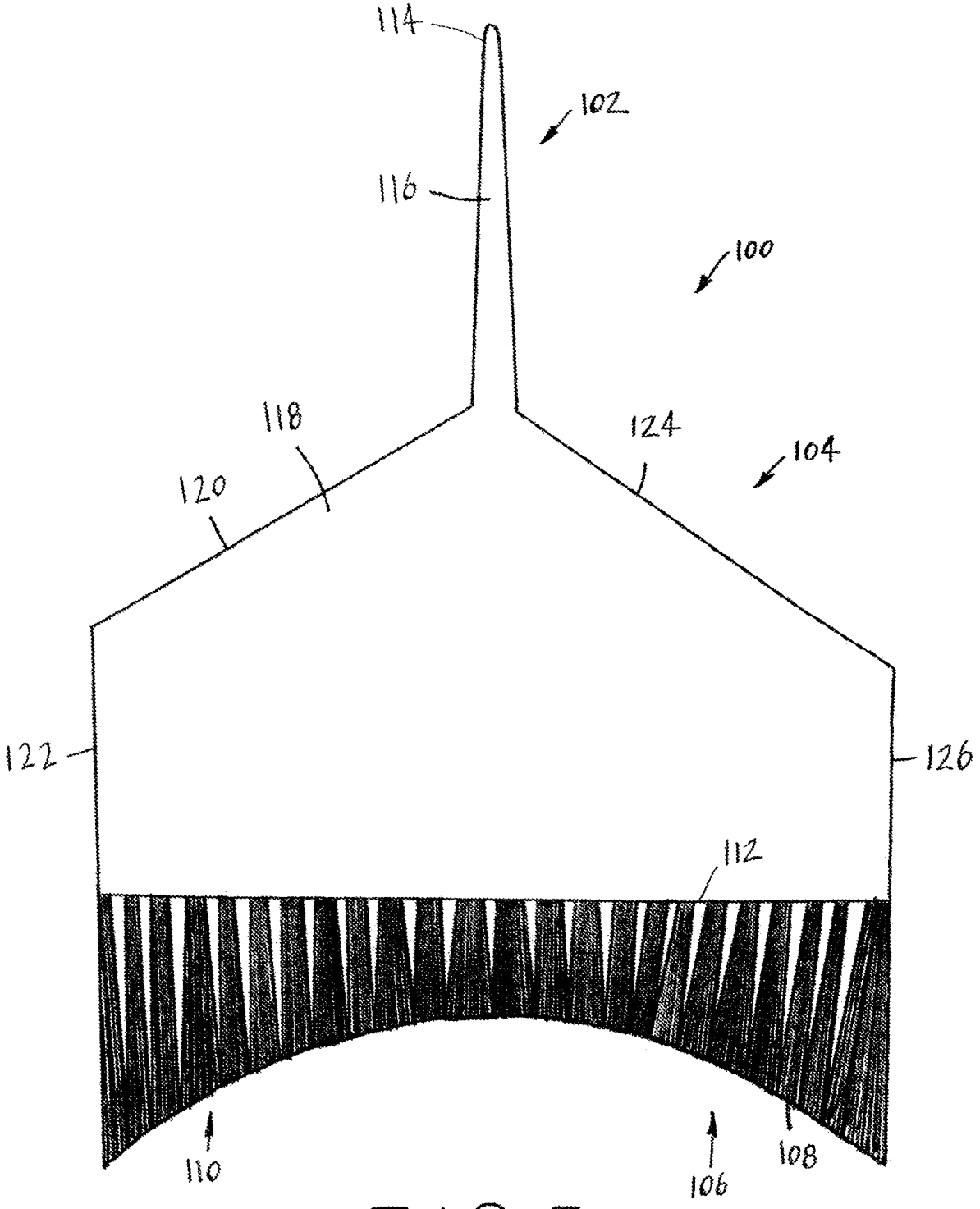
FIG. 5 is a front perspective view of another embodiment of a hair coloring brush constructed according to the present disclosure.

With particular reference now to FIG. 5, another embodiment of a hair coloring brush 100 is illustrated. The hair coloring brush 100 is shown comprising a pick handle 102, a central base portion 104, and a plurality of bristles 106 extending out from the central base portion 104. The bristles 106 each have an end portion 108 with the end portions 108 forming a curved surface 110. The central base portion 104 has a straight end portion 112 from which the bristles 106 extend. The pick handle 102 has an end 114 and a tapered portion 116 that extends from the central base portion 104 to the end 114. The pick handle 102 is used to assist in sectioning hair that needs to be colored or dyed by the brush 100. The central base portion 104 has a front side 118 that is large and is adapted for a hand of an operator of the brush 100 to be able to firmly grasp. The central base portion 104 also has a first angled side portion 120, a first straight side portion 122, a second angled side portion 124, and a second straight side portion 126. The first angled side portion 120 is between the tapered portion 116 and the first straight side portion 122. The first straight side portion 122 ends at the straight end portion 112. The second angled side portion 124 is between the tapered portion 116 and the second straight side portion 126. The second straight side portion 126 also terminates at the straight end portion 112. As can be appreciated, the curved surface 110 of the end portions 108 of the bristles 106 are used to follow the contoured shape of a head. In this manner, it will be easy to stroke hair with dye (not shown) applied to the brush 100 or apply dye to hair by using the brush 100.

Figure 6:
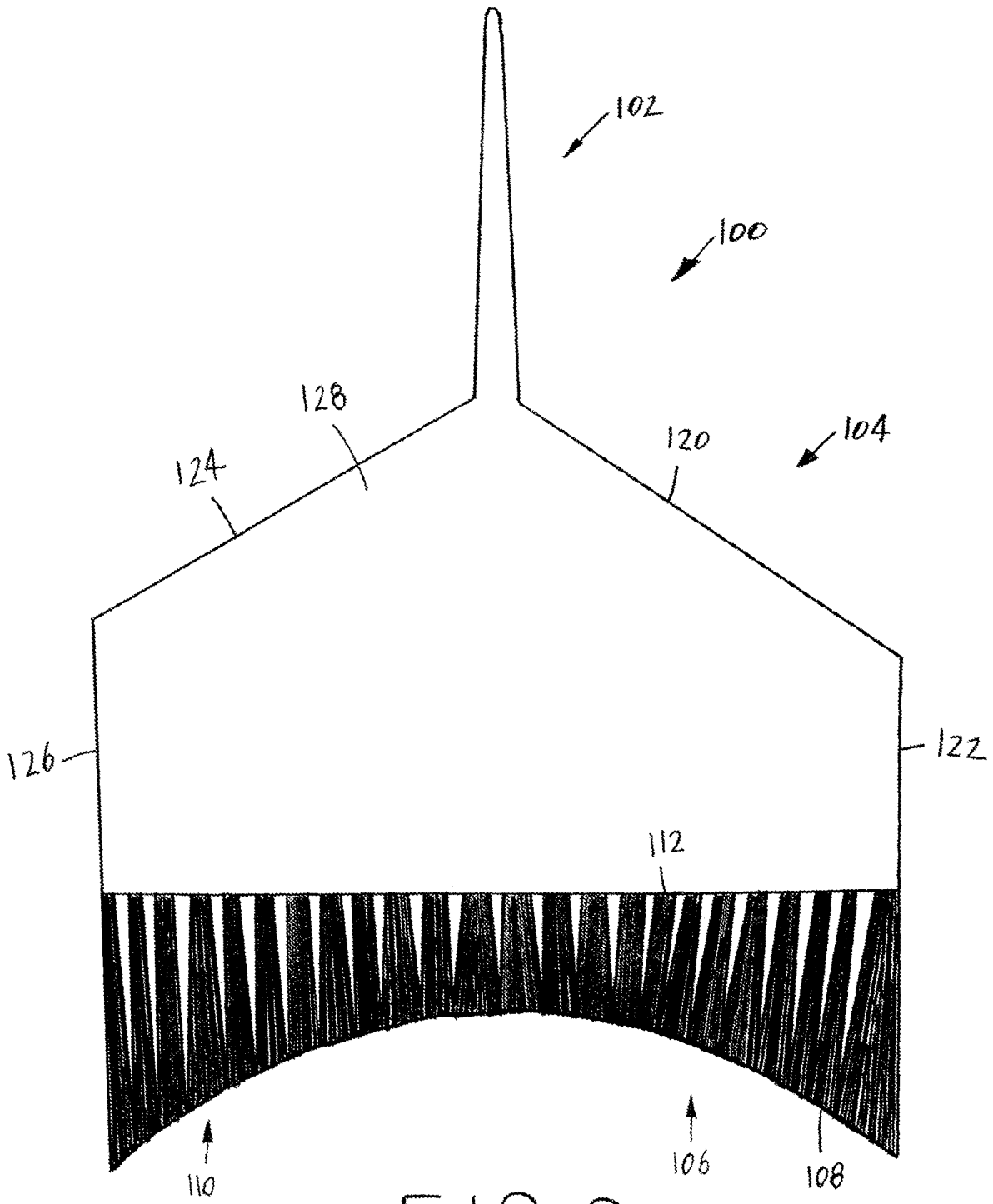
FIG. 6 is a back perspective view of the hair coloring brush shown in FIG. 5 constructed according to the present disclosure.

FIG. 6 illustrates a back perspective view of the hair coloring brush 100. The hair coloring brush 100 is shown comprising the pick handle 102, the central base portion 104, and the plurality of bristles 106 extending out from the central base portion 104. The bristles 106 each have the end portion 108 with the end portions 108 forming the curved surface 110. The central base portion 104 also has the straight end portion 112 from which the bristles 106 extend. The pick handle 102 has the end 114 and the tapered portion 116 that extends from the central base portion 104 to the end 114. The central base portion 104 has a back side 128 that is large and is adapted for a hand of an operator of the brush 100 to be able to firmly grasp. The central base portion 104 is also shown having the first angled side portion 120, the first straight side portion 122, the second angled side portion 124, and the second straight side portion 126.

Figure 7:
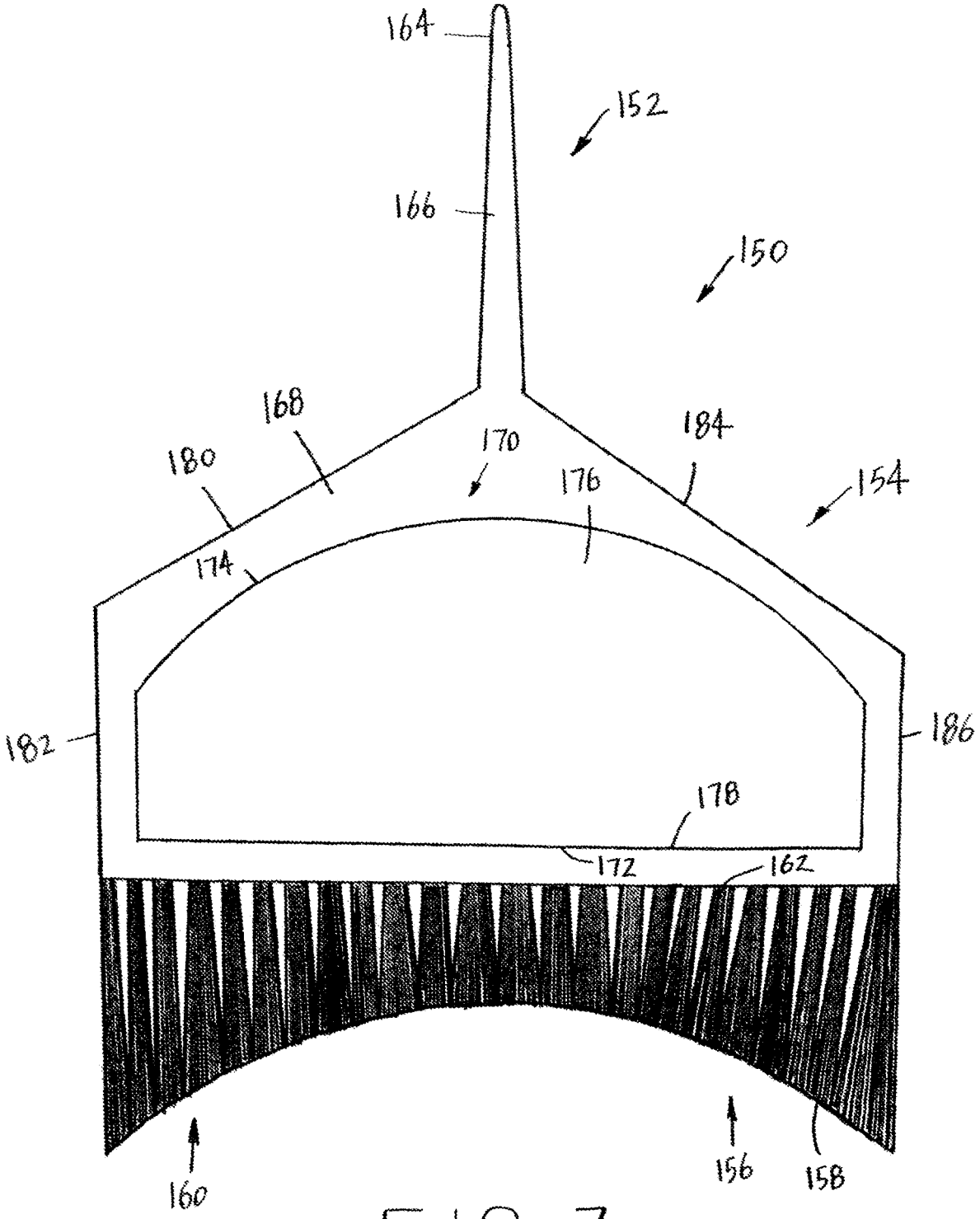
FIG. 7 is a front perspective view of another embodiment of a hair coloring brush constructed according to the present disclosure.

Referring to FIG. 7, another embodiment of a hair coloring brush 150 is shown comprising a pick handle 152, a central base portion 154, and a plurality of bristles 156 extending out from the central base portion 154. The bristles 156 each have an end portion 158 with the end portions 158 forming a curved surface 160. The central base portion 154 has a straight end portion 162 from which the bristles 156 extend. The pick handle 152 has an end 164 and a tapered portion 166 that extends from the central base portion 154 to the end 164. The pick handle 152 is used to assist in sectioning hair that needs to be colored or dyed by the brush 150. The central base portion 154 has a front side 168 that is large and is adapted for a hand of an operator of the brush 150 to be able to firmly grasp. The central base portion 154 has an indentation 170 formed in the front side 168. The indentation 170 has a straight bottom end 172 and a circular upper end 174. The indentation 170 provides an area 176 for grasping the brush 150 in a comfortable manner by an operator or user of the brush 150. The curved bottom end 172 provides a surface 178 against which fingers of an operator may be positioned for more control of the brush 150. The central base portion 154 also has a first angled side portion 180, a first straight side portion 182, a second angled side portion 184, and a second straight side portion 186. The first angled side portion 180 is between the tapered portion 166 and the first straight side portion 182. The first straight side portion 182 ends at the straight end portion 162. The second angled side portion 184 is between the tapered portion 166 and the second straight side portion 186. The second straight side portion 186 also terminates at the straight end portion 162. As can be appreciated, the curved surface 160 of the end portions 158 of the bristles 156 are used to follow the contoured shape of a head. In this manner, it will be easy to stroke hair with dye (not shown) applied to the brush 150 or apply dye to hair by using the brush 150.

Figure 8:
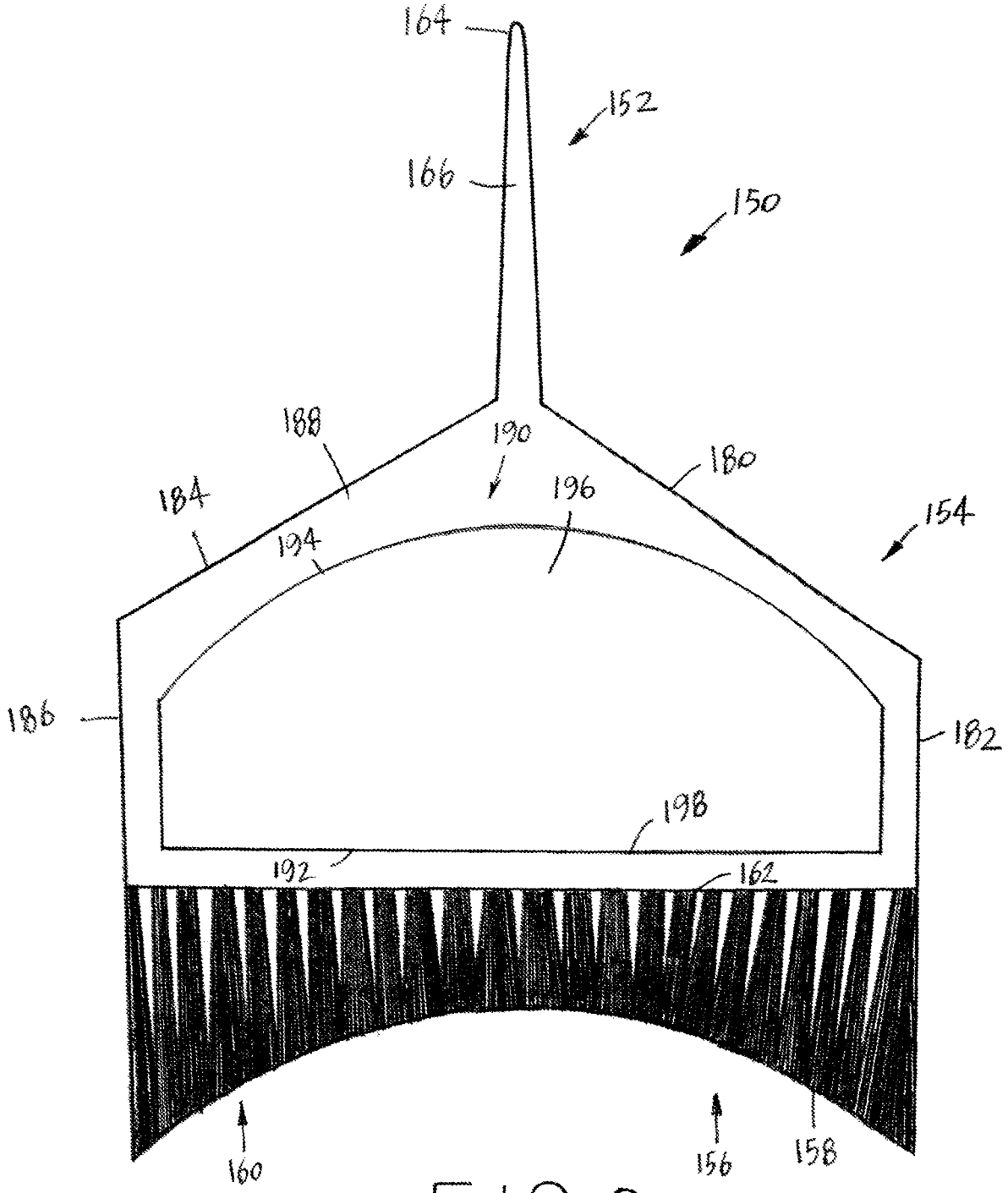
FIG. 8 is a back perspective view of the hair coloring brush shown in FIG. 7 constructed according to the present disclosure.

FIG. 8 illustrates a back perspective view of the hair coloring brush 150. The hair coloring brush 150 is shown comprising the pick handle 152, the central base portion 154, and the plurality of bristles 156 extending out from the central base portion 154. The bristles 156 each have the end portion 158 with the end portions 158 forming the curved surface 160. The central base portion 154 also has the straight end portion 162 from which the bristles 156 extend. The pick handle 152 has the end 164 and the tapered portion 166 that extends from the central base portion 154 to the end 164. The central base portion 154 has a back side 188 that is large and is adapted for a hand of an operator of the brush 150 to be able to firmly grasp. The central base portion 154 is also shown having the first angled side portion 180, the first straight side portion 182, the second angled side portion 184, and the second straight side portion 186. The central base portion 154 has an indentation 190 formed in the back side 188. The indentation 190 has a straight bottom end 192 and a circular upper end 194. The indentation 190 provides an area 196 for grasping the brush 150 in a comfortable manner by an operator or user of the brush 150. The straight bottom end 192 provides a surface 198 against which fingers of an operator may be positioned for more control of the brush 150.

Figure 9:
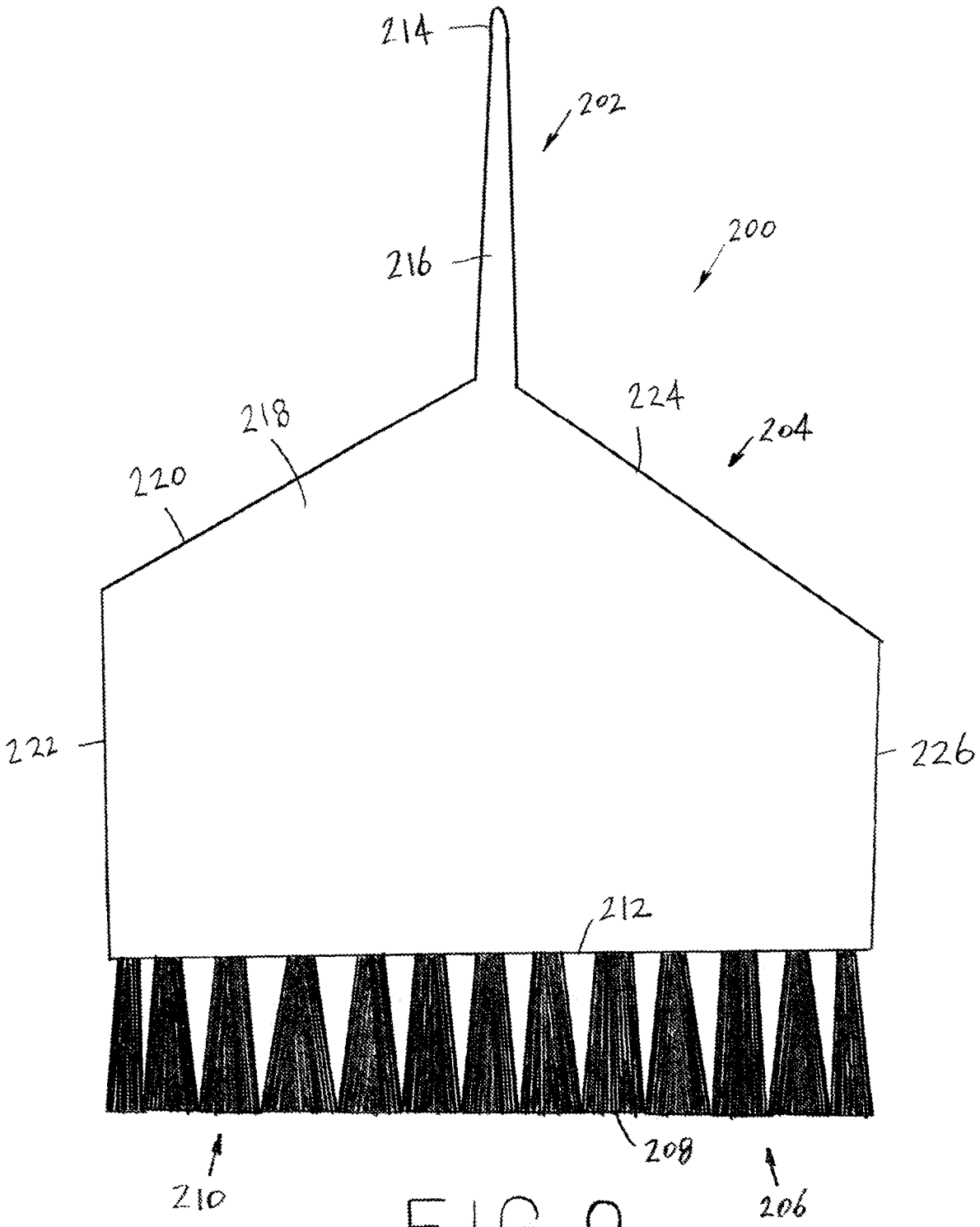
FIG. 9 is a front perspective view of another embodiment of a hair coloring brush constructed according to the present disclosure.

Referring to FIG. 9, another embodiment of a hair coloring brush 200 is shown comprising a pick handle 202, a central base portion 204, and a plurality of bristles 206 extending out from the central base portion 204. The bristles 206 each have an end portion 208 with the end portions 208 forming a straight surface 210. The central base portion 204 has a straight end portion 212 from which the bristles 206 extend. The pick handle 202 has an end 214 and a tapered portion 216 that extends from the central base portion 204 to the end 214. The pick handle 202 is used to assist in sectioning hair that needs to be colored or dyed by the brush 200. The central base portion 204 has a front side 218 that is large and is adapted for a hand of an operator of the brush 200 to be able to firmly grasp. The central base portion 204 also has a first angled side portion 220, a first straight side portion 222, a second angled side portion 224, and a second straight side portion 226. The first angled side portion 220 is between the tapered portion 216 and the first straight side portion 222. The first straight side portion 222 ends at the straight end portion 212. The second angled side portion 224 is between the tapered portion 216 and the second straight side portion 226. The second straight side portion 226 also terminates at the straight end portion 212. Although not shown, it is possible and contemplated that the central base portion 204 may have an indentation formed in the front side 218. Also, not visible in this particular view is a back side of the brush 200. Again, the back side of the brush 200 may also have an indentation formed in the central base portion 204.

Figure 10:
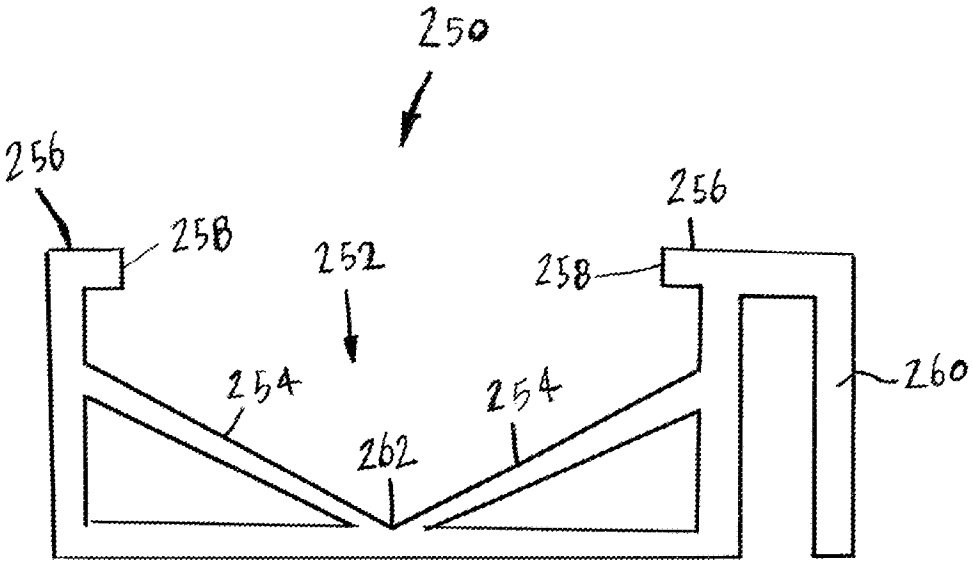
FIG. 10 is a cross-sectional view of an embodiment of a bowl for a hair coloring brush system constructed according to the present disclosure.

With particular reference now to FIG. 10, a cross-sectional view of a bowl or receptacle 250 used with any of the brushes 10, 50, 100, 150, or 200 to form a hair coloring brush system is shown. The bowl 250 comprises a basin portion 252 having an interior V-shaped wall 254, a rim 256, a ledge or a rest portion 258 positioned adjacent to the rim 256 in the basin 252, and a handle 260. The ledge 258 is used to place or rest any of the brushes 10, 50, 100, 150. or 200 thereon or against. The V-shaped wall 254 allows any chemicals, such as hair dye or hair color, to settle at a bottom 262 of the basin 252. The V-shaped wall 254 also allows the any of the brushes 10, 50, 100, 150, or 200 to rest therein and to be able to easily remove any of the brushes 10, 50, 100, 150, or 200. The handle 260 is used to stabilize the bowl 250. As can be appreciated, the basin 252 is large enough to allow any of the brushes 10, 50, 100, 150, or 200 to fit therein.

Figure 11:
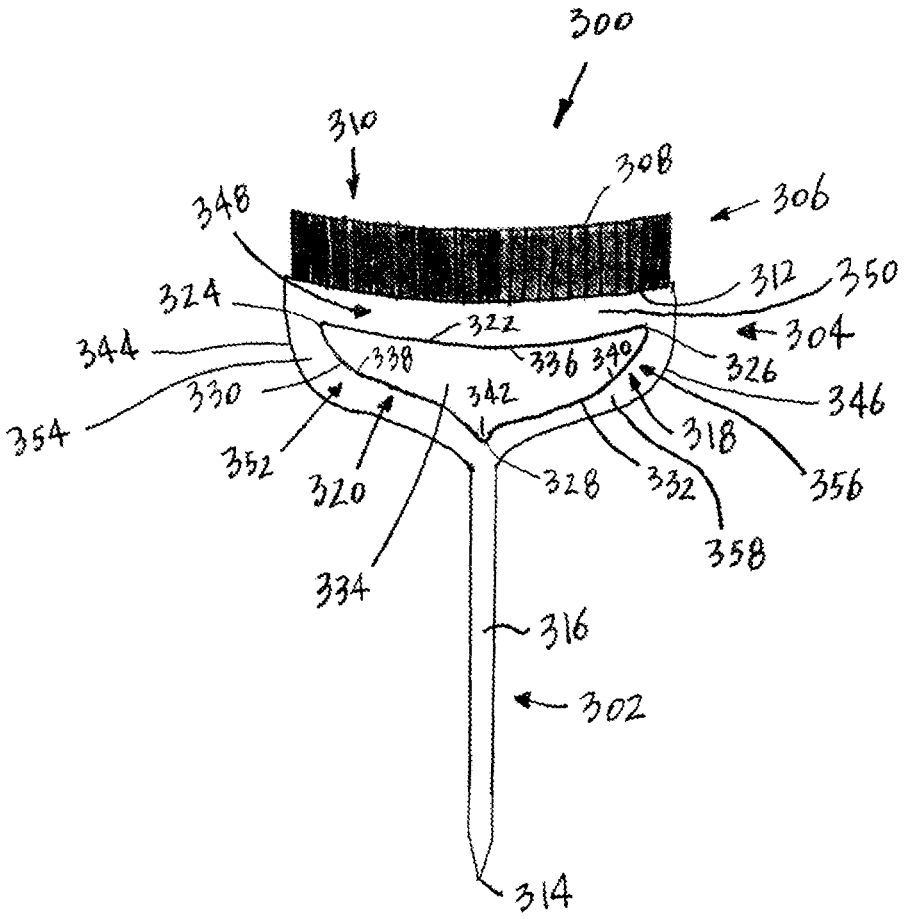
FIG. 11 is a front perspective view of a hair coloring brush constructed according to the present disclosure.

FIG. 11 illustrates another embodiment of a hair coloring brush 300. The hair coloring brush 300 comprises a pick handle 302, a central base portion 304, and a plurality of bristles 306 extending out from the central base portion 304. The bristles 306 each have a curved end portion 308 with the end portions 308 forming a curved surface 310. The central base portion 304 has a curved end portion 312 from which the bristles 306 extend. The pick handle 302 has an end 314 and an elongated portion 316 that extends from the central base portion 304 to the end 314. The pick handle 302 is used to assist in sectioning hair that needs to be colored or dyed by the brush 300. The central base portion 304 has a front side 318 that is large and is adapted for a hand of an operator of the brush 300 to be able to firmly grasp. The central base portion 304 has an indentation 320 formed in the front side 318. The indentation 320 has a curved bottom end 322, a first rounded corner 324, a second rounded corner 326, a central indented portion 328, a first curved side 330 positioned between the first rounded corner 324 and the central indented portion 328, and a second curved side 332 positioned between the second rounded corner 326 and the central indented portion 328. The indentation 320 provides an area 334 for grasping the brush 300 in a comfortable manner by an operator or user of the brush 300. The curved bottom end 322 provides a curved bottom surface 336 against which fingers of an operator may be positioned for more control of the brush 300. The curved bottom surface 336 assists in positively holding or grasping the brush 300 when in use. In particular, the curved bottom surface 336 is used when applying dye to hair in an upward or downward motion to better control the brush 300 because the fingers are positioned in a curved manner against the curved bottom surface 336 which mimics the curved end portions 308 of the bristles 306. The first curved side 330 has a first curved side surface 338 and the second curved side 332 has a second curved side surface 340. The central indented portion 328 has a central indented surface 342 in which a finger may be placed for controlling the brush 300. The central base portion 304 also has a first outer curved side 344 between the curved end portion 312 and the pick handle 302 and a second outer curved side 346 between the curved end portion 312 and the pick handle 302. A central non-indented portion or surface 348 is formed between the curved end portion 312 and the curved bottom end 322. The central non-indented portion 348 has a first length 350 defined between the curved end portion 312 and the curved bottom end 322. A first non-indented portion or surface 352 is formed between the first curved side 330 and the first outer curved side 344. The first non-indented portion 352 has a second length 354 defined between the first curved side 330 and the first outer curved side 344. A second non-indented portion or surface 356 is formed between the second curved side 332 and the second outer curved side 346. The second non-indented portion 356 has a third length 358 defined between the second curved side 332 and the second outer curved side 346. The first length 350 is greater than the second length 354 and the third length 358. The second length 354 is equal to the third length 358. The first length 350 is used to set back fingers of an operator of the brush 300 to provide better or enhanced control of the brush 300. As can be appreciated, the curved surface 310 of the end portions 308 of the bristles 306 are used to follow the contoured shape of a head. In this manner, it will be easy to stroke hair with dye (not shown) applied to the brush 300 or apply dye to hair by using the brush 300.

Figure 12:
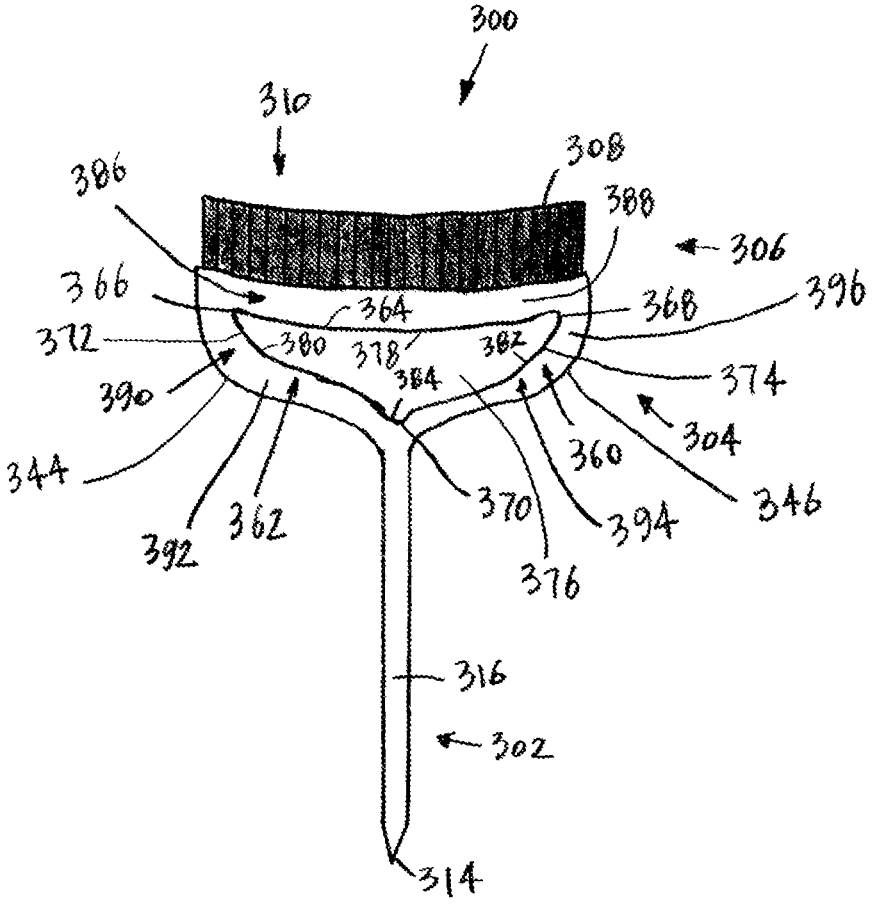
FIG. 12 is a back perspective view of the hair coloring brush shown in FIG. 11 constructed according to the present disclosure.

With reference now to FIG. 12, a back perspective view of the brush 300 is depicted. The hair coloring brush 300 is shown comprising the pick handle 302, the central base portion 304, and the plurality of bristles 306 extending out from the central base portion 304. The bristles 306 each have the curved end portion 308 with the end portions 308 forming the curved surface 310. The central base portion 304 also has the curved end portion 312 from which the bristles 306 extend. The pick handle 302 has the end 314 and the elongated portion 316 that extends from the central base portion 304 to the end 314. The central base portion 304 has a back side 360 that is large and is adapted for a hand of an operator of the brush 300 to be able to firmly grasp. The central base portion 304 has an indentation 362 formed in the back side 360. The indentation 362 has a curved bottom end 364, a first rounded corner 366, a second rounded corner 368, a central indented portion 370, a first curved side 372 positioned between the first rounded corner 366 and the central indented portion 372, and a second curved side 374 positioned between the second rounded corner 368 and the central indented portion 370. The indentation 362 provides an area 376 for grasping the brush 300 in a comfortable manner by an operator or user of the brush 300. The curved bottom end 364 provides a curved bottom surface 378 against which fingers of an operator may be positioned for more control of the brush 300. The curved bottom surface 378 assists in positively holding or grasping the brush 300 when in use. In particular, the curved bottom surface 378 is used when applying dye to hair in an upward or downward motion to better control the brush 300 because the fingers are positioned in a curved manner against the curved bottom surface 378 which mimics the curved end portions 308 of the bristles 306. The first curved side 372 has a first curved side surface 380 and the second curved side 374 has a second curved side surface 382. The central indented portion 370 has a central indented surface 384 in which a finger may be placed for controlling the brush 300. The central base portion 304 also has the first outer curved side 344 between the curved end portion 312 and the pick handle 302 and the second outer curved side 346 between the curved end portion 312 and the pick handle 302. A central non-indented portion or surface 386 is formed between the curved end portion 312 and the curved bottom end 364. The central non-indented portion 386 has a first length 388 defined between the curved end portion 312 and the curved bottom end 364. A first non-indented portion or surface 390 is formed between the first curved side 372 and the first outer curved side 344. The first non-indented portion 390 has a second length 392 defined between the first curved side 372 and the first outer curved side 344. A second non-indented portion or surface 394 is formed between the second curved side 374 and the second outer curved side 346. The second non-indented portion 394 has a third length 396 defined between the second curved side 374 and the second outer curved side 346. The first length 388 is greater than the second length 392 and the third length 396. The second length 392 is equal to the third length 396. The first length 388 is used to set back fingers of an operator of the brush 300 to provide better or enhanced control of the brush 300. As can be appreciated, the curved surface 310 of the end portions 308 of the bristles 306 are used to follow the contoured shape of a head. In this manner, it will be easy to stroke hair with dye (not shown) applied to the brush 300 or apply dye to hair by using the brush 300. The indentation 362 provides the area 376 for grasping the brush 300 in a comfortable manner by an operator or user of the brush 300. The curved bottom end 364 provides the surface 378 against which fingers of an operator may be positioned for more control of the brush 300. Although the indentation 362 is shown, it is possible that the central base portion 304 on the back side 360 may not have the indentation 362 formed therein. By having one indentation 320 (FIG. 11) formed in the brush 300, a user of the brush 300 will be able to know which direction dye is being applied by the brush 300. For example, if the brush 300 is to be moved only in a downward direction then knowing that the indentation 320 is only on the front side 318 of the brush 300 will allow the user to be able to orientate the brush 300 for a downward stroke.

As can be appreciated, the brushes 10, 50, 100, 150, 200, and 300 can be constructed of any suitable material such as plastic, polymer, metal, wood, or a combination of these materials. The bristles 16, 56, 106, 156, 206, and 306 may also be formed of any suitable material such as plastic, polymer, synthetic material, natural materials, or a combination of these materials. The brushes 10, 50, 100, 150, 200, and 300 are suitable for single use or multiple uses. For example, the brushes 10, 50, 100, 150, 200, and 300 can be disposable or can be cleaned of dye after each use and then used again to apply dye. It is also possible that the brushes may be manufactured in different colors so that the same brush may be used for applying the same color on different individuals. It is also contemplated that the brush 300 may be used with the bowl or receptacle 250 to form a hair coloring brush system.

From all that has been said, it will be clear that there has thus been shown and described herein a hair coloring brush and system which fulfills the various objects and advantages sought therefore. It will become apparent to those skilled in the art, however, that many changes, modifications, variations, and other uses and applications of the subject hair coloring brush and system are possible and contemplated. All changes, modifications, variations, and other uses and applications which do not depart from the spirit and scope of the are deemed to be covered by the subject mattress protector and removable cover assembly, which is limited only by the claims which follow.

What is claimed is:

1. A hair coloring brush comprising:

a central base portion having a curved end portion, a front side, and an indentation formed in the front side, the indentation having a curved bottom end, a first rounded corner, a second rounded corner, a central indented portion, the curved bottom end curved toward the central indented portion, a first curved side positioned between the first rounded corner and the central indented portion, and a second curved side positioned between the second rounded corner and the central indented portion, the central indented portion being between the first curved side and the second curved side and opposite the curved bottom end, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, and a central curved non-indented surface formed between the curved end portion and the curved bottom end;

a pick handle extending from the central base portion; and a plurality of bristles extending out from the curved end portion of the central base portion, the bristles each have an end portion with the end portions forming a curved surface.

2. The hair coloring brush of claim 1 wherein the central base portion further comprises a first outer curved side between the curved end portion and the pick handle and a second outer curved side between the curved end portion and the pick handle.

3. The hair coloring brush of claim 1 wherein the central base portion further comprises a first non-indented portion formed between the first curved side and the first outer curved side and a second non-indented portion formed between the second curved side and the second outer curved side.

4. The hair coloring brush of claim 3 wherein the central curved non-indented portion has a first length defined between the curved end portion and the curved bottom end.

5. The hair coloring brush of claim 1 wherein the central base portion further comprises a first non-indented portion formed between the first curved side and the first outer curved side.

6. The hair coloring brush of claim 1 wherein the central base portion further comprises a second non-indented portion formed between the second curved side and the second outer curved side.

7. The hair coloring brush of claim 1 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side.

8. The hair coloring brush of claim 1 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side with the first length being greater than the second length.

9. A hair coloring brush comprising:

a central base portion having a curved end portion, a front side, a back side, an indentation formed in the front side, the indentation having a curved bottom end, a first rounded corner, a second rounded corner, a central indented portion, the curved bottom end curved toward the central indented portion, a first curved side positioned between the first rounded corner and the central indented portion, and a second curved side positioned between the second rounded corner and the central indented portion, the central indented portion being between the first curved side and the second curved side and opposite the curved bottom end, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, and an indentation formed in the back side, the indentation having a curved bottom end, a first rounded corner, a second rounded corner, a central indented portion, a first curved side positioned between the first rounded corner and the central indented portion, and a second curved side positioned between the second rounded corner and the central indented portion, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, and a central curved non-indented surface formed between the curved end portion and the curved bottom end;

a pick handle extending from the central base portion; and a plurality of bristles extending out from the central base portion, the bristles each have an end portion with the end portions forming a curved surface.

10. The hair coloring brush of claim 9 wherein the central base portion further comprises a first outer curved side between the curved end portion and the pick handle and a second outer curved side between the curved end portion and the pick handle.

11. The hair coloring brush of claim 9 wherein the central base portion further comprises a first central non-indented portion formed in the front side between the first curved side and the first outer curved side and a second non-indented portion formed between the second curved side and the second outer curved side.

12. The hair coloring brush of claim 9 wherein the central base portion further comprises a central curved non-indented portion formed in the back side between the curved end portion and the curved bottom end.

13. The hair coloring brush of claim 9 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side.

14. The hair coloring brush of claim 9 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side.

15. The hair coloring brush of claim 9 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side with the first length being greater than the second length.

16. The hair coloring brush of claim 9 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side with the first length being greater than the second length.

17. A hair coloring brush system comprising:

a central base portion having a curved end portion, a front side, and an indentation formed in the front side, the indentation having a curved bottom end, a first rounded corner, a second rounded corner, a central indented portion, the curved bottom end curved toward the central indented portion, a first curved side positioned between the first rounded corner and the central indented portion, and a second curved side positioned between the second rounded corner and the central indented portion, the central indented portion being between first curved side and the second curved side and opposite the curved bottom end, the indentation providing an area for grasping the brush, the curved bottom end providing a curved bottom surface against which fingers of an operator may be positioned in a curved manner for controlling the brush and the central indented portion having a central indented surface against which a finger of an operator may be positioned for controlling the brush, and a central curved non-indented surface formed between the curved end portion and the curved bottom end;

a pick handle extending from the central base portion;

a plurality of bristles extending out from the central base portion, the bristles each have an end portion with the end portions forming a curved surface; and a bowl for holding a quantity of dye and having a basin for receiving the bristles and the central base portion.

18. The hair coloring brush system of claim 17 wherein the bowl further comprises a basin portion having a V-shaped wall, a rim, a ledge positioned below the rim in the basin, and a handle.

19. The hair coloring brush system of claim 17 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side.

20. The hair coloring brush system of claim 17 wherein the central curved non-indented portion has a first length defined between the curved end portion and the curved bottom end, a first non-indented portion formed between the first curved side and the first outer curved side, the first non-indented portion having a second length defined between first curved side and the first outer curved side, a second non-indented portion formed between the second curved side and the second outer curved side, and the second non-indented portion having a third length defined between the second curved side and the second outer curved side with the first length being greater than the second length.

* * * * *